US011553292B2

(12) United States Patent
Hasani et al.

(10) Patent No.: US 11,553,292 B2
(45) Date of Patent: Jan. 10, 2023

(54) IN-THE-EAR HEARING DEVICE

(71) Applicant: Sivantos Pte. Ltd., Singapore (SG)

(72) Inventors: Hamed Hasani, Erlangen (DE); Martin Schmidt, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/375,124

(22) Filed: Jul. 14, 2021

(65) Prior Publication Data

US 2022/0030364 A1 Jan. 27, 2022

(30) Foreign Application Priority Data

Jul. 21, 2020 (DE) ..... 102020209124.2

(51) Int. Cl.
*H04R 25/00* (2006.01)

(52) U.S. Cl.
CPC ..... *H04R 25/65* (2013.01); *H04R 2225/025* (2013.01); *H04R 2225/51* (2013.01)

(58) Field of Classification Search
CPC ..... H04R 25/65; H04R 2225/51; H04R 2225/025
See application file for complete search history.

(56) References Cited

U.S. PATENT DOCUMENTS

| | | | | |
|---|---|---|---|---|
| 10,256,529 | B2 | 4/2019 | Yang et al. | |
| 10,257,624 | B2 | 4/2019 | Rabel et al. | |
| 2004/0138723 | A1 | 7/2004 | Malick et al. | |
| 2005/0244024 | A1 | 11/2005 | Fischer et al. | |
| 2011/0142270 | A1* | 6/2011 | Niederdrank | H01Q 1/273 381/315 |
| 2015/0296312 | A1* | 10/2015 | Nikles | H04R 25/554 381/315 |
| 2016/0050502 | A1* | 2/2016 | Kvist | H04R 25/554 381/315 |
| 2016/0330552 | A1* | 11/2016 | Flood | H01Q 1/273 |

FOREIGN PATENT DOCUMENTS

| | | | | |
|---|---|---|---|---|
| DE | 102004017832 | B3 | 10/2005 | |
| EP | 2750409 | A1 | 7/2014 | |
| EP | 3133839 | A1 * | 2/2017 | H04R 25/554 |
| EP | 3133839 | A1 | 2/2017 | |
| EP | 3322202 | A1 | 5/2018 | |
| EP | 3491846 | B1 | 6/2020 | |
| WO | 2018024620 | A1 | 2/2018 | |

* cited by examiner

*Primary Examiner* — Sunita Joshi
(74) *Attorney, Agent, or Firm* — Laurence A. Greenberg; Werner H. Stemer; Ralph E. Locher

(57) ABSTRACT

An in-the-ear (ITE) hearing aid has a housing that is designed for insertion into an ear canal of a hearing aid wearer. The housing has a housing shell. The housing shell has an antenna, in particular a folded, capacitively charged dipole antenna. The antenna is mounted in particular on an outer surface of the housing shell.

12 Claims, 3 Drawing Sheets

IN-THE-EAR HEARING DEVICE

CROSS-REFERENCE TO RELATED APPLICATION

This application claims the priority, under 35 U.S.C. § 119, of German patent application DE 10 2020 209 124.2, filed Jul. 21, 2020; the prior application is herewith incorporated by reference in its entirety.

BACKGROUND OF THE INVENTION

Field of the Invention

The invention relates to an in-the-ear (ITE) hearing device with a housing which is provided for insertion into an ear canal of a hearing aid wearer. The housing has a housing shell.

In-the-ear (ITE) hearing devices and hearing aids are generally distinguished by the fact that essential hearing aid components, for example a signal processor, a receiver (loudspeaker) and preferably also a microphone, are arranged inside the housing, which is designed to be arranged in the ear canal. ITE hearing aids are understood here in particular also as ITC (in-the-canal), CIC (completely-in-the-canal) or IIC (invisible-in-the-canal) hearing aids. These hearing aids are designed to compensate for hearing loss in a hearing-impaired person by means of suitable signal processing and amplification.

In such hearing devices, an option of wireless communication is often provided, for example for communication with external devices, such as, with a smart phone or with an external audio device for direct wireless transmission of audio signals, or also for example, especially in binaural hearing aids, for communication between two hearing aids. That communication generally requires a suitable receiver/transmitter including a suitable antenna.

BRIEF SUMMARY OF THE INVENTION

It is accordingly an object of the invention to provide an ITE hearing device which overcomes the above-mentioned disadvantages of the heretofore-known devices and methods of this general type and which permits efficient wireless communication in an ITE hearing aid.

With the above and other objects in view there is provided, in accordance with the invention, an in-the-ear (ITE) hearing device, comprising:

a housing configured for insertion into an ear canal of a hearing device wearer;

said housing having a housing shell and said housing shell having an antenna.

In other words, the objects are achieved, according to the invention, by an ITE hearing device, or hearing aid with a housing which is designed for insertion into an ear canal of a hearing aid wearer and which has a housing shell. The housing shell in turn has an antenna, which is designed for wireless communication. While the description relates to a hearing aid, it should be understood that the device is, more generally, a hearing device which is configured for use by persons with or without hearing impairment and loss, or hearing deficiencies.

The antenna is designed particularly for transmitting and/or receiving frequencies in the radiofrequency range, for example in the range of 500 MHz to several GHz (5 to 10 GHz). For example, the antenna is designed in particular for a frequency of 2.4 GHz, i.e., a resonant frequency of the antenna is set to this frequency. A transmitting/receiving unit is typically arranged inside the hearing aid. It is connected to the antenna and, in a receiving mode, evaluates the signals received from the antenna and optionally forwards these signals to a signal processor, which is likewise integrated in the hearing aid, i.e. in the housing. Conversely, the transmitting unit is designed for the processing of actuating signals for the antenna in a transmitting mode.

At least one microphone and a receiver are also preferably arranged in the hearing aid. Acoustic sound received from the microphone is converted into an electromagnetic signal and forwarded to the signal processor and is individually processed there according to the individual hearing loss of a hearing-impaired person, in order to compensate for the hearing loss of this person. The processed signals are finally sent to the receiver and are there typically converted back into sound.

It is of particular importance now that the housing shell, i.e. the outer boundary of the housing of the hearing aid, has the antenna itself. The antenna is thus deliberately routed from the interior of the housing into the housing shell.

This is based on the consideration that ITE hearing aids on the whole are of a very small construction, but that at the same time the antenna, especially an antenna adapted for the desired radiofrequency range, needs to have a sufficient physical length in order to permit efficient wireless signal transmission. By arranging the antenna on the housing shell, a location with a maximum possible extent is therefore chosen, which results in an efficient transmitting or receiving antenna.

In a preferred embodiment, the antenna is mounted on an outer face of the housing shell. Thus, apart from the antenna mounted on the outside, the outer face forms the outermost surface region of the housing. The antenna is therefore mounted on the housing shell from the outside. In this way, the maximum possible geometry of the housing is utilized. As an alternative to this, the antenna could also be integrated in the interior of the housing shell. However, this reduces the maximum size, and therefore the arrangement on the outer face is the preferred variant.

In a preferred embodiment, the antenna has a conductor structure, and also a film-like carrier on which the conductor structure is mounted. The antenna is thus designed in the manner of a film antenna. The film-like carrier, together with the conductor structure mounted thereon, is designed in particular as what is called a Flex PCB, i.e. a flexible printed circuit board. This film-like carrier is mounted, for example adhesively bonded, on the outer face of the housing shell. Alternatively, the film-like carrier is omitted, and the conductor structure is mounted directly on the housing shell.

Moreover, the antenna is preferably mounted peripherally around the housing shell. It is therefore as it were wound around the housing shell. The antenna covers a large part of the outer face of the housing shell, for example at least half, preferably at least two thirds or also at least 90% of the surface area of the outer face of the housing shell. That is to say, the surface area enclosed by the conductor structure of the antenna corresponds to half, ⅔ or 90% of the surface area of the outer face of the housing shell.

In an expedient embodiment, the antenna is a dipole antenna, especially a capacitively charged dipole antenna. Moreover, the dipole antenna is preferably what is known as a folded dipole antenna. A dipole antenna is understood generally as an antenna which has a dipole structure extending in an antenna longitudinal direction. A folded dipole antenna is understood as an antenna with a dipole conductor structure which, parallel to the dipole conductor structure, has a second conductor, the ends of which are connected to the ends of the dipole conductor structure. "Capacitive charge" is moreover understood as meaning that, at the end of the dipole arms of the dipole antenna, i.e. of the dipole structure, additional conductor structure elements are arranged by which the capacitance is increased in relation to a simple rod-shaped dipole antenna. The capacitive charge generally has the effect that a resonant frequency of the dipole antenna is reduced or, conversely, that an actual physical length of the dipole antenna is reduced at the same resonant frequency. This means that, compared to an antenna without capacitive charge, the length of the conductor structure can be made shorter at a predetermined resonant frequency (corresponds to the transmitting and/or receiving frequency). This is of particular importance in view of the limited space available in an ITE hearing aid.

In an expedient embodiment, the antenna is moreover mounted on the housing shell in such a way that a main radiating direction is oriented in a longitudinal direction of the housing. This longitudinal direction is generally defined by a direction which, in the inserted state, is oriented toward the outside of the ear canal. Since the ear canal, in particular the external auditory canal, generally narrows toward the middle ear (inner ear) and the housing is adapted to the geometry of the ear canal, the housing likewise narrows toward the inner/middle ear. This means, conversely, that the housing widens in the longitudinal direction toward the outside. Generally, the housing shell is initially open to the outside in the longitudinal direction and there has an outer opening. The hearing aid components are generally inserted via this outer opening. At least some of these hearing aid components, for example signal processor, transmitting/receiving unit and microphone, are usually arranged on a carrier plate referred to as a faceplate, which to this extent closes the outwardly directed opening of the housing shell and thus forms part of the housing. The longitudinal direction is preferably oriented perpendicularly with respect to this faceplate or also to a surface area defined by the outer opening.

By virtue of the antenna being particularly arranged such that the main radiating direction is oriented in this longitudinal direction, a very high degree of efficiency is achieved, since incoming and/or outgoing signals are received/transmitted as directly as possible, without having to pass through regions of the body.

The "main radiating direction" is understood as meaning that at least 50% of a transmitting power of the antenna is radiated parallel to the longitudinal direction or at an angle range which is defined by a radiating angle of 30° or at most 50° with respect to the longitudinal direction.

In an expedient embodiment, the antenna, in an unfolded state, has a central excitation point from which two mutually opposite dipole arms extend in and counter to an antenna longitudinal direction. Endpieces, by which the aforementioned capacitive charge is obtained, are formed at the ends of these two dipole arms. The endpieces at the same time also form the connection of the mutually opposite ends of the dipole structure (conductor extending in antenna longitudinal direction) to the conductor running parallel to the dipole structure in the folded dipole antenna. An "unfolded state" is understood as a starting state of the antenna before application to the housing shell, i.e. when the antenna is open in a two-dimensional plane. This two-dimensional sheet structure is then placed around the housing shell in order to form a three-dimensional antenna structure.

The endpieces are preferably each U-shaped, with a base limb and two mutually opposite side limbs. The two side limbs are also designated as a pair of side limbs. The base limb in each case connects one end of the dipole structure to one end of the conductor running parallel to the dipole structure.

These two pairs of side limbs are preferably oriented toward each other in the unfolded or developed state, i.e., they are to this extent arranged with mirror symmetry to each other.

The two dipole arms, in the region of the central excitation point, preferably have terminal subportions which, compared to other portions of the dipole arms, extend further forward at an outer opening of the housing shell, as seen in the longitudinal direction. No side limbs of the endpieces run in this circumferential region of the forwardly extended subportions. In this way, the excitation point is brought as close as possible to the outer opening. A faceplate is generally inserted into the outer opening. With the terminal subportions and thus the excitation point being brought close to the opening, this promotes an advantageous possibility of attaching the excitation point to the faceplate.

In an expedient embodiment, a parallel arm is moreover provided, which is designed parallel to the dipole arms and which likewise connects the two mutually opposite endpieces to each other. This parallel arm to this extent defines the conductor running parallel to the dipole conductor structure in a folded dipole antenna.

The thereby defined conductor structure of the antenna has proven particularly expedient.

The central excitation point is generally understood as a middle region between the two dipole arms, where the transmitting/receiving unit is attached by corresponding conductor connections. In the case of transmission, the signals from the transmitting unit are thus fed in at this excitation point. In the case of reception of a signal, the signal is collected from the receiving unit at the excitation point. Transmitting unit and receiving unit thus use the same excitation point and therefore the same conductor connections.

The dipole arms and the parallel arm are preferably connected electrically conductively in a middle region on the base limb of the two endpieces. The base limb in each case runs in particular perpendicularly with respect to the dipole arms and the parallel arms. The side limbs in turn preferably run parallel to the dipole arms and the parallel arm.

In an expedient embodiment, the dipole arms and in particular also the side limbs running parallel thereto are arranged in a circumferential direction around the housing shell. The circumferential direction is in particular oriented perpendicularly with respect to the longitudinal direction, i.e. the dipole arms run at least approximately and/or over a large part of their length (>75% of the length) perpendicularly with respect to the longitudinal direction. Perpendicularly with respect to the longitudinal direction is also understood here as an inclination of +/−20° or only of +/−10° to the longitudinal direction.

This arrangement promotes the aforementioned suitable radiating characteristics in the longitudinal direction. Generally therefore, the antenna longitudinal direction, which is defined substantially by the direction of extent of the dipole arms, is oriented in the circumferential direction and thus transversely with respect to the longitudinal direction of the housing.

In an expedient embodiment, the U-shaped endpieces are arranged on the housing shell with their base limbs lying opposite each other. Preferably, no further conductor structure of the antenna is arranged between the two base limbs.

The base limbs are preferably spaced apart from each other by only a short distance (<10% or <5% of the circumference), i.e. the whole antenna structure is arranged around almost the entire circumference of the housing shell (angle range >340°, preferably >350°).

Other features which are considered as characteristic for the invention are set forth in the appended claims.

Although the invention is illustrated and described herein as embodied in ITE hearing device or hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1A:
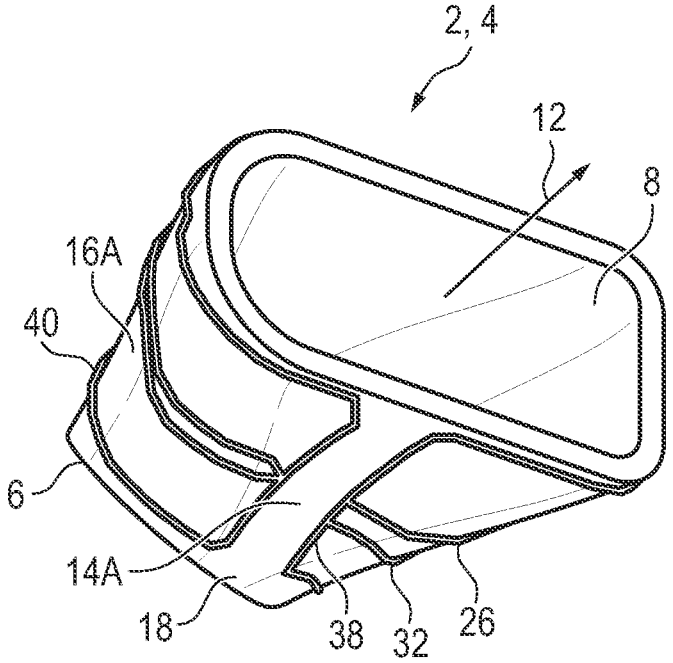
FIGS. 1A, 1B, 1C, and 1D are perspective views of a housing shell of an ITE hearing aid with a mounted antenna in accordance with the invention.

Parts and elements having the same function and functionality are provided with the same reference signs throughout the figures.

DETAILED DESCRIPTION OF THE INVENTION

Referring now to the figures of the drawing in detail, the housing shell 2 shown in FIGS. 1A to 1D forms a part of a housing 4 of an ITE hearing aid. The housing 4, especially the housing shell 2, is adapted in its outer shape, or exterior, to the typical geometry of an ear canal and is to this extent designed for insertion into the ear canal of a person, especially a hearing-impaired person. The housing shell 2 typically widens from an inner end region, and from an inner opening 6 of the housing shell 2 located there, to an outer end region, and to an outer opening 8 of the housing shell 2 located there. The terms inner and outer are used with reference to the insertion direction of the hearing device into the ear canal of the user. The housing shell 2 is thus open at both end faces of the end regions. In the finished hearing aid, a receiver (loudspeaker) is typically arranged in the inner opening 6. A faceplate (not shown here) is typically inserted at the opposite outer opening 8. In the illustrative embodiment, the outer opening 8 has an at least approximately rectangular shape with two long sides and two short sides, wherein the corner regions are rounded. The sides can also have a curved shape, as is shown by way of example for one of the short sides. The hearing aid components, for example a signal processor, a microphone, and a transmitter/receiver unit for transmitting/receiving wireless signals, etc., are arranged on the afore-mentioned faceplate, which is not illustrated here. The faceplate closes the outer opening 8 and is to this extent a part of the housing 4.

The housing 4 extends generally in a longitudinal direction 12, which is oriented from the inner opening 6 to the outer opening 8. The longitudinal direction 12 is in particular oriented perpendicularly with respect to the surface area of the outer opening 8.

In the illustrative embodiment, the housing shell 2, especially on account of the configuration of the outer opening 8 as a rectangular opening, has two mutually opposite main sides 14A, 14B and two mutually opposite secondary sides 16A, 16B.

The housing shell 2 generally has an outer face 18. An antenna 20 is mounted on the latter, the antenna 20 being shown particularly in FIG. 2 in an unfolded starting state. This antenna 20 has a special conductor structure 22 which is formed by metal tracks, in particular copper conductor tracks. In a design variant, the conductor structure 22 is mounted on a film-like carrier 24, such that the antenna 20 is formed as a whole in the manner of a flexible printed circuit. The film-like carrier 24 is indicated for example in FIG. 2 by a dashed line.

Figure 2:
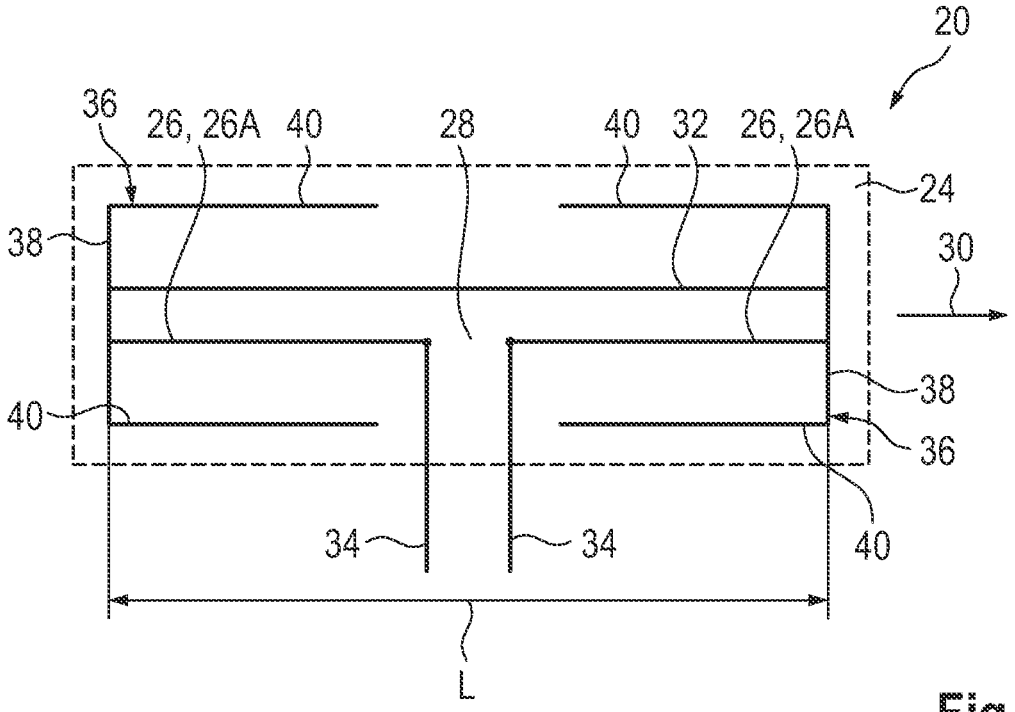
FIG. 2 is a plan view showing the antenna in an unfolded starting state.

As can be seen from FIG. 2, in the unfolded starting state the antenna 20, especially the conductor structure 22, has two dipole arms 26 which, starting from a central excitation point 28, extend in a straight line in and counter to an antenna longitudinal direction 30. Parallel to these two dipole arms 26 in the illustrative embodiment, a parallel arm 32 is provided which likewise extends in the antenna longitudinal direction 30. The two dipole arms 26 are spaced apart from each other at the central excitation point 28. At the excitation point 28, the two dipole arms 26 are contacted via attachment lines 34 and are connected to a transmitter/receiver unit (not shown in detail here).

A capacitive charge of the antenna 20 is formed at the ends of the dipole arms 26. For this purpose, the end of each dipole arm 26 is adjoined by a U-shaped endpiece 36 which, in the illustrative embodiment, has a base limb 38 and two side limbs 40. The side limbs 40 preferably each extend parallel to the dipole arms 26 and thus parallel to the antenna longitudinal direction 30. The side limbs 40 of the two endpieces 36 are oriented toward each other, i.e. the U-shaped conductor track structures each formed by the endpieces 36 are oriented with their open ends toward each other and to this extent are arranged with mirror symmetry to each other. The side limbs 40 preferably extend over a relatively great length of the entire antenna structure, for example over a length in the region of between 0.25 times and 0.4 times the entire length L of the antenna 20. In the illustrative embodiment, the length L of the antenna 20 is defined by the distance in antenna longitudinal direction 30 between the two base limbs 38.

The arrangement of this antenna, shown in FIG. 2, on the housing shell 2 is shown in FIGS. 1A to 1D. The antenna 20 is generally wound around the housing shell 2, i.e. it is placed in a circumferential direction 42 around the housing shell 2. The circumferential direction 42 runs approximately perpendicularly with respect to the longitudinal direction 12. It corresponds substantially or exactly to the antenna longitudinal direction 30.

The antenna 20 overall has a length L which corresponds almost to the circumference of the housing shell 2 and, for example, lies in the range between 70% and 95% of the housing circumference.

As can be seen from FIG. 1A, which shows a view of the first main side 14A and the first secondary side 16A, the end regions of the antenna 20, especially the endpieces 36, lie opposite each other on the housing shell 2. The two base limbs 38 are therefore oriented toward each other, and the respective side limbs 40 are oriented away from each other. Between the two base limbs 38, a free space is formed in which no conductor tracks are arranged. The side limbs 40 and also the dipole arms 26 run in the circumferential direction 42, at least in the region of the main sides 14A, 14B.

Figure 1B:
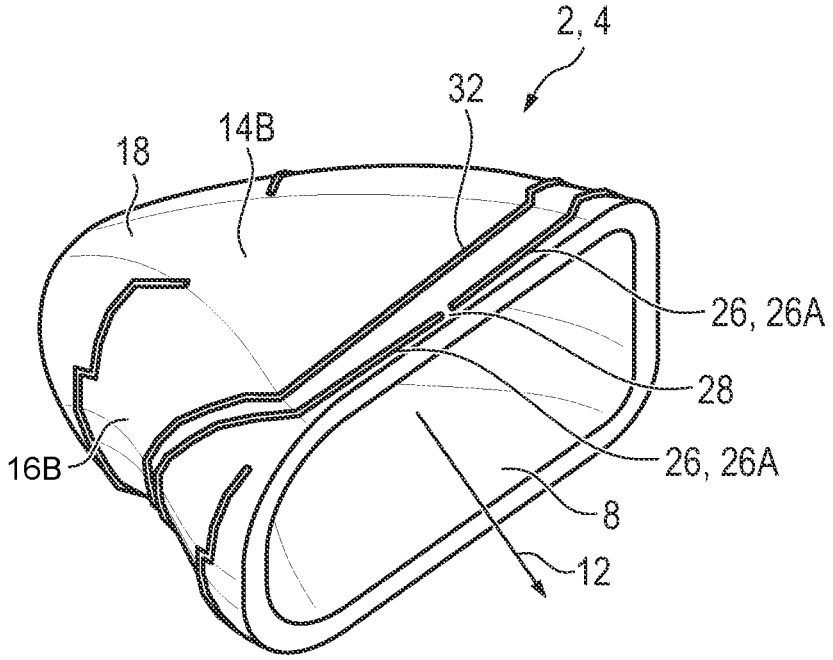

FIG. 1B shows a perspective view of the housing shell 2, directed to the second main side 14B and partially also to the first secondary side 16A. It will be seen that the dipole arms 26 and also the parallel arm 32 likewise run, on the first main side, parallel or at least substantially parallel to the circumferential direction 42. In a transition region, preferably in the region of the secondary sides 16A, 16B, the dipole arms 26 are extended forward in the longitudinal direction 12, i.e. in the transition region the portions of the dipole arms 26 do not run perpendicular to the longitudinal direction. This has the effect that, with respect to the longitudinal direction 12, subportions of the dipole arms run at different length levels perpendicular to the longitudinal direction 12. The forwardly extended subportion 26A preferably runs at least approximately at the same axial height as a respective forward side limb 40, as viewed in the longitudinal direction 12.

The side limbs 40 no longer run in the region of the forwardly extended subportions 26A. The forwardly extended subportions 26A lie in the middle region of the antenna, where the excitation point 28 is arranged. In particular, these forwardly extended subportions 26A of the dipole arms 26 run near and parallel to the outer opening 8. The central excitation point 28 is therefore also arranged very near to the outer opening 8 and thus directly adjacent the faceplate. The electrical connection and contacting of the two dipole arms 26 at the excitation point 28 is provided, for example, by attachment lines which are contacted from outside or alternatively are also guided through the housing shell 2.

Figure 1C:
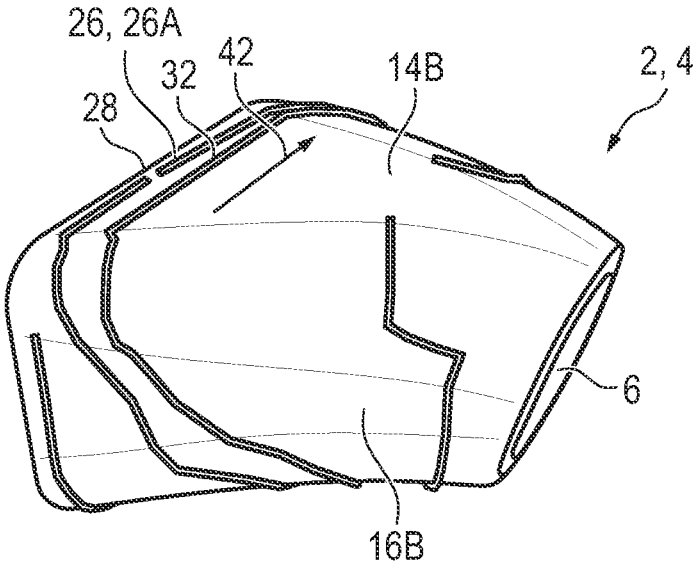
Figure 1D:
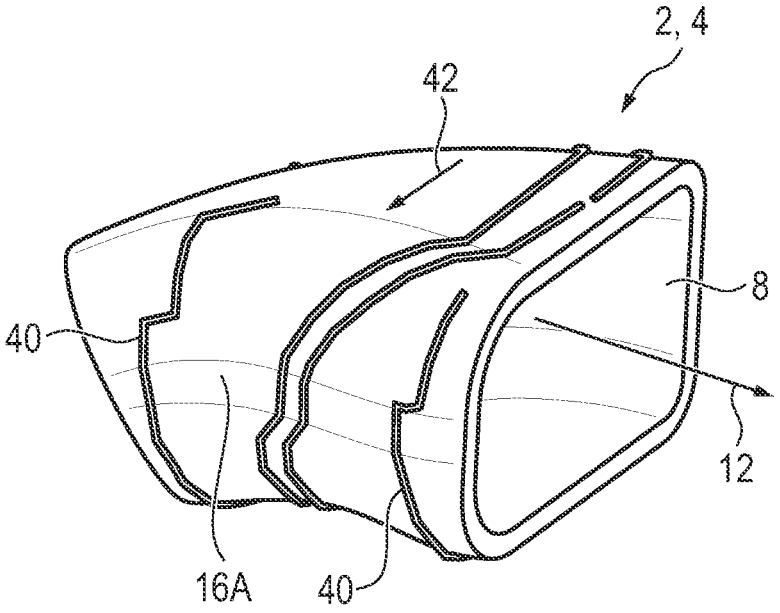

FIG. 1C lastly shows a view of the second secondary side 16B and the second main side 14B. FIG. 1D shows in turn a perspective view directed to the first secondary side 16A and the second main side 14B. It will be clearly seen from these two figures that the dipole arms 26 and the parallel arm 32 are each guided forward in longitudinal direction 12 in the region of the secondary sides 16A, 16B. That is to say, in the region of the secondary sides 16A, 16B, the dipole arm and the parallel arm are oriented obliquely with respect to the longitudinal direction 12.

With the antenna 20 arranged as described here on the outer face 18 of the housing shell 2, in conjunction with the special structure of the antenna 20, it is possible to obtain an antenna 20 which on the whole is efficient and sensitive and which has a main radiating direction and main receiving direction in and respectively counter to the longitudinal direction 12. The antenna 20 is distinguished by the capacitive charging through the arrangement of the endpieces 36. By virtue of the arrangement on the outer face 18, the greatest possible physical length of the folded dipole antenna 20 is obtained.

The invention is not limited to the illustrative embodiment described above. Rather, other embodiments are also possible within the scope defined by the claims.

The following is a summary list of reference numerals and the corresponding structure used in the above description of the invention:

2 housing shell
4 housing
6 inner opening
8 outer opening
12 longitudinal direction
14A first main side
14B second main side
16A first secondary side
16B second secondary side
18 outer face
20 antenna
22 conductor structure
24 film-like carrier
26 dipole arm
26A subportion
28 excitation point
30 antenna longitudinal direction
32 parallel arm
34 attachment line
36 endpiece
38 base limb
40 side limb
42 circumferential direction
L length

The invention claimed is:

1. An in-the-ear (ITE) hearing device, comprising:

a housing configured for insertion into an ear canal of a hearing device wearer;

said housing having a housing shell and said housing shell having an antenna;

said antenna, in an unfolded state thereof, having a central excitation point and two mutually opposite dipole arms extending from said central excitation point in and counter to an antenna longitudinal direction, and wherein angled endpieces are formed at ends of said dipole arms for capacitive charging.

2. The hearing device according to claim 1, wherein said antenna is mounted on an outer face of said housing shell.

3. The hearing device according to claim 1, wherein said antenna has a conductor structure mounted on a film carrier, said film carrier being mounted on said housing shell.

4. The hearing device according to claim 1, wherein said antenna is a dipole antenna.

5. The hearing device according to claim 4, wherein said antenna is a folded dipole antenna.

6. The hearing device according to claim 4, wherein said antenna is a capacitively charged dipole antenna.

7. The hearing device according to claim 1, wherein said housing shell widens in a longitudinal direction and said antenna is mounted on said housing shell with a main radiating direction of said antenna oriented in the longitudinal direction.

8. The hearing device according to claim 1, wherein each of said endpieces is U-shaped, with a pair of side limbs and a base limb.

9. The hearing device according to claim 8, wherein said mutually opposite pairs of side limbs are oriented toward each other.

10. The hearing device according to claim 1, wherein said two dipole arms, in a region of said central excitation point, are formed with subportions which, compared to other portions of the dipole arms, extend farther forward at an outer opening of said housing shell, as seen in the antenna longitudinal direction.

11. The hearing device according to claim 8, wherein said dipole arms run in a circumferential direction around said housing shell.

12. The hearing device according to claim 8, wherein said base limbs are arranged lying opposite each other on said housing shell.

* * * * *